US005531164A

United States Patent [19]

Mosley

[11] Patent Number: 5,531,164

[45] Date of Patent: Jul. 2, 1996

[54] SELECT FIRE GUN ASSEMBLY AND ELECTRONIC MODULE FOR UNDERGROUND JET PERFORATING USING RESISTIVE BLASTING CAPS

[75] Inventor: Demmie L. Mosley, Pampa, Tex.

[73] Assignee: Titan Specialties, Inc., Pampa, Tex.

[21] Appl. No.: 438,403

[22] Filed: May 10, 1995

[51] Int. Cl.[6] ..... F42B 3/00

[52] U.S. Cl. ..... 102/312; 102/313; 102/202.12

[58] Field of Search ..... 102/312, 313, 102/202, 202.12

[56] References Cited

U.S. PATENT DOCUMENTS

| | | | |
|---|---|---|---|
| 5,105,742 | 4/1992 | Sumner | 102/313 X |
| 5,322,019 | 6/1994 | Hyland | 102/312 |
| 5,355,802 | 10/1994 | Petitjean | 102/313 |
| 5,359,935 | 11/1994 | Willett | 102/307 |

*Primary Examiner*—Peter A. Nelson
*Attorney, Agent, or Firm*—Klein & Szekeres

[57] ABSTRACT

A select fire gun assembly for jet perforating includes a plurality of shaped charges capable of being detonated by blasting caps activated by passage of current through the cap. The first electric terminal of the blasting cap on the bottom of the assembly is grounded. The remaining blasting caps are electrically connected to a dart that grounds only after the charge below has been detonated. The other terminal of each blasting cap is connected to the logging cable through a first diode, and these diodes are arranged in sequentially alternating polarity. The first terminal of each cap is also connected electrically through a large resistor to the gate of an electronic switch which is closed either by positive or negative voltage, depending on the nature of the switch. The switch is open when the gate is grounded. The electronic switch is incorporated in series with the logging cable. Positive and negative gated electronic switches are connected to the blasting caps in alternative sequence. A second diode is placed in series with the logging cable and parallel with the electronic switch that is associated with each blasting cap. The first and second diodes are arranged in opposite polarity to one another, and the electronic switch is in opposite polarity with the corresponding second diode. The diodes, electronic switch and the resistor for each cap is incorporated in an electronic module, the lead wires of which are mounted to the logging cable, blasting cap and the dart.

20 Claims, 3 Drawing Sheets

35
34
48
± SWITCH
15
36
121Ω
42
38
46
44
40
B1
30
B2
B3

YELLOW
32
BLUE
WHITE/
BLACK
STRIPE
BLACK

YELLOW
BLUE
WHITE/
RED
STRIPE
RED

SELECT FIRE GUN ASSEMBLY AND ELECTRONIC MODULE FOR UNDERGROUND JET PERFORATING USING RESISTIVE BLASTING CAPS

BACKGROUND OF THE INVENTION

1. Field of the Invention

The present invention is in the field of a gun assembly used for underground jet perforating while exploring for oil and/or gas and extracting the same from underground. More particularly, the present invention is directed to a gun assembly containing a plurality of shaped charges, the explosion of which is triggered by resistive blasting caps and which can be detonated in sequential order, and to an electronic module that renders the sequential detonation possible.

2. Background Art

It has been common practice for a long time in the oil and gas production industry to perforate the wall of the oil or gas well casing at locations where entry of oil or gas from the surrounding formation into the casing is desired. The prior art has created shaped explosive charges for this purpose. The charges are detonated by passing current through a blasting cap that ignites the charge through a detonating fuse. The term "shaped charge" in this regard is well understood in the art, and denotes an explosive charge specifically adapted for the purpose of creating certain desired size holes in the casing, and a desired amount of penetration into the surrounding formation.

In connection with the foregoing, a number of shaped charges are assembled in a "gun assembly" which is lowered into the well casing on a wireline including a logging cable. Spaces in the gun assembly which contain the individual charges are separated from one another by baffle plates that are usually not destroyed when the charge below the baffle plate is detonated. Sometimes, it is satisfactory to simultaneously detonate all shaped charges in the gun assembly. More frequently, however, it is desired to detonate the shaped charges sequentially, one by one, usually starting with the shaped charge that is located at the bottom of the gun assembly. This is commonly called "select fire" in the trade, and the prior art has developed several methods for accomplishing such "select fire" detonation. One such method utilizes a rotary switch operated at the surface with which the several charges can be detonated. This method, however, has its disadvantages, primarily in that the number of charges which can be detonated in this manner is limited.

Another prior art method, that is presently believed to be the most pertinent background to the present invention permits sequential "select fire" detonation of the charges starting at the bottom of the gun assembly, by sequentially applying direct current (d. c.) voltage of alternating polarity to the logging cable from the surface. In accordance with this method, the logging cable is electrically connected through a diode to the blasting cap attached to the charge on the bottom of the gun assembly, and this blasting cap is grounded. All other blasting caps attached to the other charges above the bottom charge are not grounded. Instead they are electrically connected to the diode and a dart which is mounted through an insulating gasket to the baffle plate. The diode is also connected to the logging cable. The dart is a device, well known in the trade, that seals the baffle from the portion of the gun assembly below, when the charge immediately below the dart has been detonated. In the process, by breaking through the insulating silicone gasket, the dart also becomes electrically grounded and thereby it grounds the blasting cap to which the dart is connected.

The diodes are mounted into an electronic module that also contains a small resistor (approximately 5 Ω) which is placed in series with the logging cable. Thus, each diode is connected to the logging cable and to the blasting cap, but except for the blasting cap on the bottom of the gun assembly, the rest of the caps are grounded only after the charge immediately below the dart has been detonated. The diodes are mounted with sequentially reversed polarity, so that for example, the diode on the bottom of the assembly permits current to pass through when negative voltage is applied on the surface, the diode above that passes current on positive voltage, the one above that again on negative voltage, and so on. Therefore, when negative voltage is applied to the logging cable on the surface, the diode on the bottom allows current to pass through the blasting cap which is grounded, and the charge on the bottom is detonated. The charges above are not detonated in this first application of negative voltage because the respective blasting caps are not grounded. Nevertheless, current can flow through to the bottom diode and blasting cap, because the logging cable, including the resistors built into the modules, represent a continuous electrical path. After the first charge has detonated, the dart in the baffle above breaks through its silicon gasket, seals the baffle into which it is mounted, and electrically grounds the blasting cap attached to it. This blasting cap receives current through the corresponding diode when positive voltage is applied on the surface. Thus, in accordance with this method, a series of explosive charges built into the gun assembly can be sequentially detonated, starting with the charge on the bottom. The resistor incorporated in each electronic module in series with the logging cable, serves to allow current to flow through to the successive caps on the bottom, even if the wire below such caps is grounded.

Blasting caps are usually manufactured to activate when approximately 0.25 to 0.8 amper current flows through them. More specifically, in accordance with practice in the art, blasting cap specifications usually state that the cap will not be activated by current less than approximately 0.25 A, but are certain to be activated with 0.8 A current. The blasting caps, which until relatively recently have been used in the prior art, had very low resistance so that the 0.3 to 0.8 A current could be accomplished by applying low voltage. Relatively recently, for safety reasons, however, blasting caps have been made with higher internal resistance, so that they can be activated only with higher voltage (approximately 25 to 100 Volts). Such blasting caps are called "resistive caps" and usually have internal resistance approximately in the 50 to 120 Ω range. The just described prior art method of select fire gun assembly is not well suitable for use with resistive caps. A primary reason for this is that for the cap of such resistance to draw enough current to be activated, the parallel disposed resistor would have to have much greater resistance. However, that would require very high voltage in order to send sufficient current through the combined resistance of the resistors which are disposed between the voltage source and the blasting to be activated. Also in accordance with this prior art method of select fire, if detonation of a charge left the wire below intact and grounded, then high resistance parallel with the cap would be needed for that cap to draw enough current for activation. Consequently, use of this method is not practical when the cap itself has resistance in approximately 50 to 120 B range, or higher.

In light of the foregoing, there is a need in the art for a gun assembly containing an electronic module that permits select fire detonation of charges for jet perforation which works well with resistive blasting caps. The present invention provides such a gun assembly and electronic module.

SUMMARY OF THE INVENTION

It is an object of the present invention to provide a select fire gun assembly to be used in connection with jet perforating of casings in underground oil and gas wells, which is capable of functioning with resistive blasting caps.

It is another object of the present invention to provide an electronic module for a select fire gun assembly that operates with resistive caps, which module can be assembled to and used in connection with otherwise substantially conventional gun assembly for jet perforation.

These and other objects and advantages are attained by a gun assembly that includes a plurality of shaped charges which are capable of being detonated by blasting caps activated by passage of current through the cap. The first electric terminal of the blasting cap on the bottom of the assembly is grounded, whereas each of the remaining blasting caps of the assembly are electrically connected to a dart that grounds only after the charge below has been detonated. The other terminal of each blasting cap is connected to the logging cable through a first diode, and the polarity of the diodes are arranged in alternative sequence.

The first terminal of the blasting cap is also connected electrically through a large resistor to the gate of an electronic switch which is closed either by positive or negative voltage depending on the nature of the switch. The switch is open when the gate is grounded. The electronic switch is incorporated in series with the logging cable. Positive and negative gated electronic switches, which are connected to the blasting caps, are arranged in alternative sequence. The resistance of the large resistor is orders of magnitude greater than the resistance of the blasting cap. A second diode is placed in series with the logging cable and parallel with the electronic switch that is associated with each blasting cap. The first and second diodes are arranged in opposite polarity to one another, and the electronic switch is in opposite polarity to the corresponding second diode. The diodes, electronic switch and the large resistor for each cap may be conveniently incorporated in an electronic module, having 4 lead wires, which are mounted to the logging cable, blasting cap and the dart, respectively.

The features of the present invention can be best understood together with further objects and advantages by reference to the following description, taken in connection with the accompanying drawings, wherein like numerals indicate like parts.

DESCRIPTION OF THE PREFERRED EMBODIMENT

The following specification taken in conjunction with the drawings sets forth the preferred embodiment of the present invention. The embodiment of the invention disclosed herein is the best mode contemplated by the inventor for carrying out his invention in a commercial environment, although it should be understood that various modifications can be accomplished within the parameters of the present invention.

Figure 1:
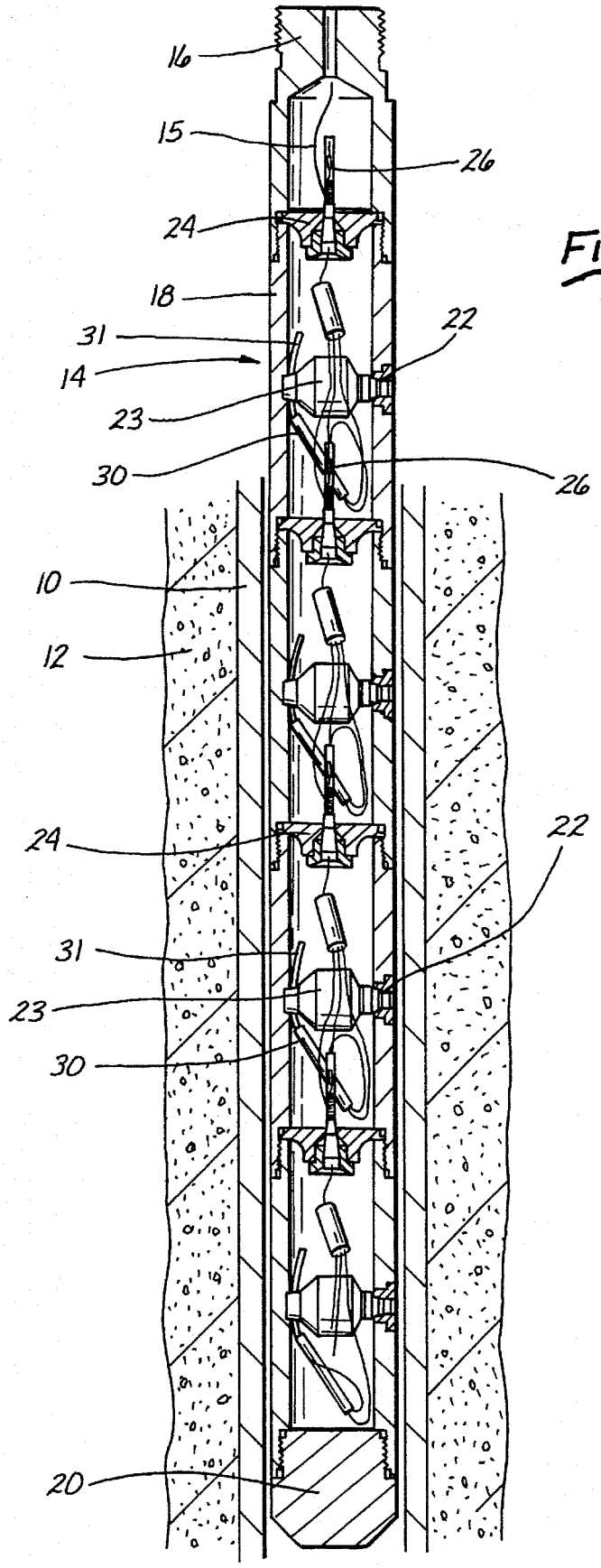
FIG. 1 is view, partly in cross section, of a jet perforating gun assembly constructed in accordance with the present invention.

Referring now to the drawing figures and particularly to FIG. 1, a preferred embodiment of the select fire gun assembly of the present invention is disclosed in the environment in which it is used. As it was noted in the introductory section of the present application for patent, the gun assembly 14 is utilized for jet perforation of well casing. Inasmuch as several components of the gun assembly are conventional, the conventional parts or components are described here only briefly. It should also be understood in connection with the present description, and particularly in connection with FIGS. 1 and 2 that these figures show an example of the invention where 4 separate explosive charges can be detonated in sequential order. However, these figures serve only as examples, in that the number of explosive charges which can be detonated in "select fire" manner in accordance with the present invention is practically unlimited; for example as many as 50 charges can be incorporated in the gun assembly of the present invention.

FIG. 1 thus shows a well casing 10 which is disposed in a formation 12. The gun assembly 14 is held in the casing, and prevented from falling in further by a wireline (not shown) that includes a single conductor electrical cable (logging cable) 15. The single conductor of the electrical cable 15 is schematically shown as a conducting line in the circuit diagram drawings of FIGS. 2, 3 and 5. The gun assembly 14 includes a top adapter subassembly or "sub" 16, a plurality (in this example 4) of carriers 18, and a gun bottom 20. The foregoing components are assembled to one another by threaded connections, or are bolted together, in accordance with the state-of-the-art. The gun assembly 14 is of a tubular overall configuration and of a diameter which fits within the well casing. Well casings vary in diameter, and accordingly the gun assemblies which may be constructed in accordance with the present invention are limited in diameter only in the sense that they must fit into the well casing in which they are intended to be used. Presently contemplated diameter for the gun assemblies of the present invention is approximately in the 1.5 to 7" range. Instead of the gun bottom 20, a bottom decentralizer assembly which is not shown here but is well known in the art, could also be used. Still in accordance with the state of the art, each carrier 18 (section of the gun assembly) has a port hole 22 or equivalent, into which an explosive charge (shaped charge) 23 is mounted, and each carrier 18 is separated from the next carrier by a baffle plate 24. The baffle plate 24 is strong enough to usually withstand the detonation of the explosive charge below and to insulate the remainder of the gun assembly from entry of fluid from the formation. A metal dart 26 in an insulating gasket (not shown) is mounted in a hole in each baffle plate 24, and the logging cable 15 is passed through the hole in the baffle 24. Still in accordance with the state-of-the-art, when a charge is detonated immediately below the baffle plate 24 and dart 26, as a result of the impact the metal dart breaks through the insulating silicone (or like) rubber gasket (not shown) and plugs the hole in the baffle 24, thereby protecting the part of the gun assembly 14 which is above the detonated part. By contacting the baffle 24 the dart 26 also becomes electrically grounded. The logging cable/conductor 15 below the dart 26 may become grounded as a result of the detonation, or may be affected in such a manner that it has no electrical connection to ground or any other component of the gun assembly 14.

Referring still to FIG. 1, a blasting cap 30 is attached to a detonating cord 31, which is in turn attached to the shaped charge 23. Although a gun assembly can be constructed in accordance with the present invention which would operate with blasting caps of the type that have low resistance, and therefore require only low voltage for activation, the present invention is specifically designed to operate with blasting caps of the type which have relatively high resistance (approximately 50 to 120 Ω or more) and which therefore require high voltage (approximately in the range of 25 to 100 V) to be activated. These type of blasting caps are commonly called resistive caps. However, as noted above, the invention will also work with blasting caps of practically no resistance. An electronic module 32 which contains components in accordance with the present invention is connected to the logging cable 15 and to each blasting cap 30 and dart 26. The electronic module 32 is preferably placed into a cylindrical housing which is made from an electrically insulating material of the type that is capable of withstanding elevated temperatures which may be encountered in the underground formation. Preferably, the material of the housing, as well as all materials and components used in the gun assembly of the present invention, are capable of withstanding temperatures up to approximately 200° C. For some applications the requirement for withstanding high temperature may be even more rigorous. The presently preferred material for the housing is high temperature resistance rubber. A negative electronic module is shown lightly shaded on FIG. 1, whereas a positive module is shown unshaded. The outside dimensions of the electronic module housing are not critical. Nevertheless, it is noted that the housing of the module of the preferred embodiment is a cylinder of approximately 0.5" diameter and approximately 1.75" long. The components of the electronic module 32 and the construction and operation of the gun assembly 14 in accordance with the present invention are further explained below, with primary reference to FIGS. 2, 3A and 3B.

Figures 2, 4A, 4B:
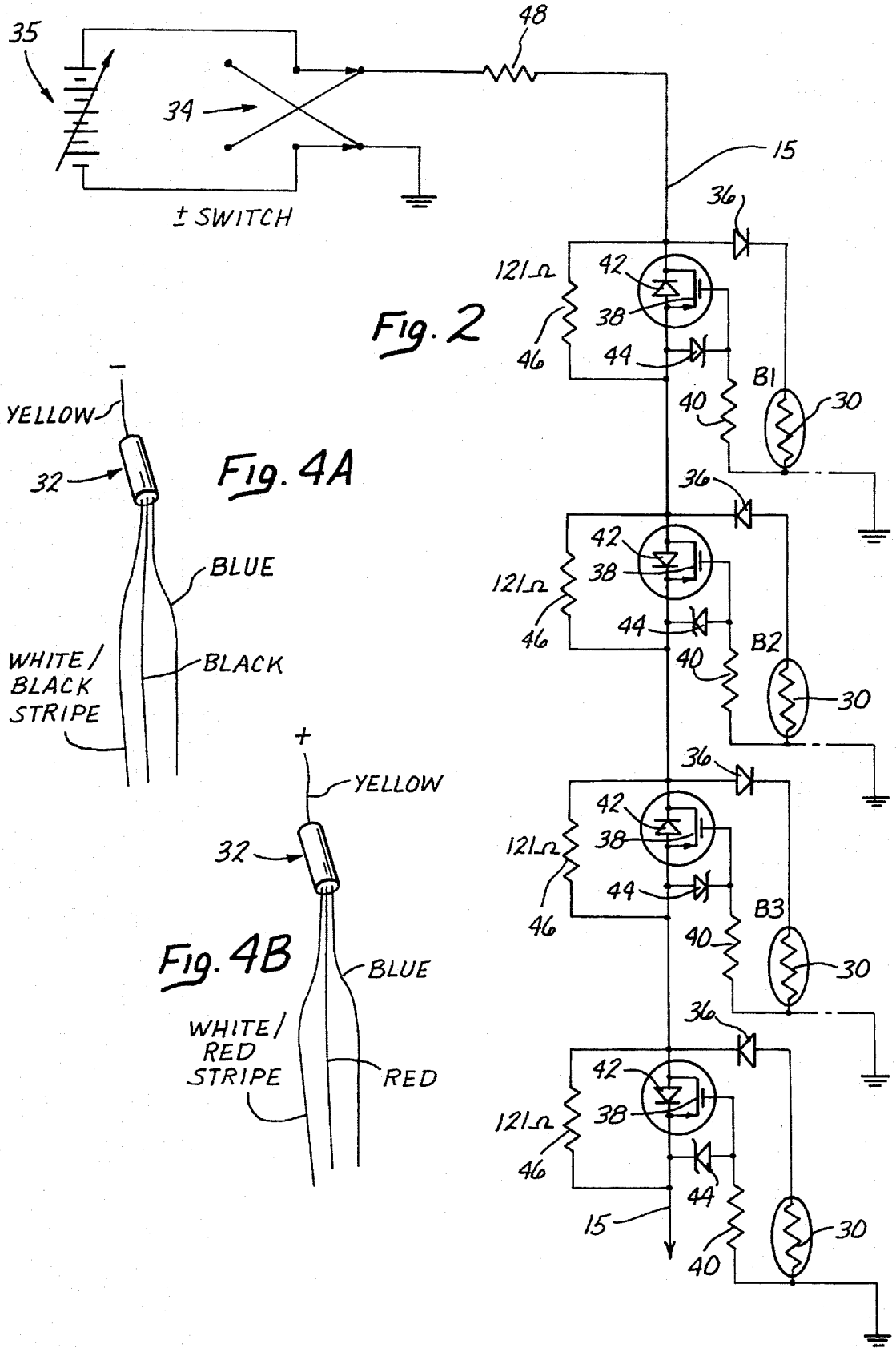
FIG. 2 is a circuit diagram of the electronic circuit used for the gun assembly shown in FIG. 1.
FIG. 4A is a perspective view of the preferred embodiment of the negative electronic module of the present invention.
FIG. 4B is a perspective view of the preferred embodiment of the positive electronic module of the present invention.

FIG. 2 depicts the circuitry involved in the operation of the gun assembly 14 of FIG. 1. It shows four circuits connected with the logging cable 15. Each one of the four circuits is associated with an explosive charge 23 that is to be detonated in a "select fire" manner. On the surface the logging cable 15 is attached to a switch 34 and direct current source 35 which are capable of applying positive or negative voltage to the cable conductor 15, at the choice of an operator (not shown). In accordance with the present invention the explosive charge 23 on the bottom of the gun assembly is to be detonated first, without detonating the charges above. The first of the four circuits, shown in the bottom of FIG. 2, includes the blasting cap 30 which is shown as a resistor placed in an ellipsoid. As it was noted above, blasting caps conforming to modern requirements typically have approximately 50 to 120 Ω resistance. As it can be seen, a first electric terminal of the blasting cap 30 is grounded and a second terminal is connected through a first diode 36 to the conductor/logging cable 15. In the herein described preferred embodiment of the invention, the explosive charge 23 on the bottom of the gun assembly 14 is arbitrarily selected to be detonated when negative voltage is applied to the cable 15 by the switch 34. Therefore, the first diode 36 is mounted so that it allows current to pass only when negative voltage is applied to the cable 15. It should be understood however, that the invention can be practiced equally well with the opposite selection of voltage required to detonate the first (bottom most) charge.

The circuit (also shown in FIG. 3B) associated with the bottom explosive charge on the bottom of the gun assembly 14 has an electronic switch 38 which is placed in series with the conductor 15. The electronic switch 38 incorporated into this circuit is designed to permit detonation when negative voltage is applied. It has a gate that closes the switch 38 only when negative voltage is applied to the gate. The electronic switch 38 also remains open when the gate is grounded. The gate of the switch 38 in the bottom circuit is electrically connected to the first terminal of the blasting cap 30 (or to the ground) through a resistor 40 of relatively large resistance, and is, therefore grounded. Still in series with the conductor 15 and parallel with the electronic switch 38, a second diode 42 is interposed in the cable 15. The second diode 42 is mounted with a polarity that is reverse to the polarity of the first diode 36. Consequently, the second diode 42 of the herein described circuit (FIG. 3B) passes current when positive voltage is applied to it.

Several well known and commercially available devices can be used for the electronic switch in accordance with the present invention. For example bipolar transistors, silicone controlled rectifiers (SCR), silicon control switches, TRIACS, MOSET transistors, insulated gate bipolar transistors (IGBT), bipolar transistors, solid state relays, junction field effect transistors or optically coupled devices and similar solid state devices can be used. The primary requirement in this regard is that the electronic switch must be able to withstand and reliably operate at approximately 200° C., and for some applications at even higher temperatures. In the herein described preferred embodiment a MOSET transistor is used for the electronic switch 38. The resistor 40 is to be of a value which is substantially greater than the resistance of the blasting cap 30, preferably it is of several orders of magnitude greater than the resistance of the blasting cap 30. In the herein described preferred embodiment the resistor 40 is of approximately 100K Ω.

Figure 3B:
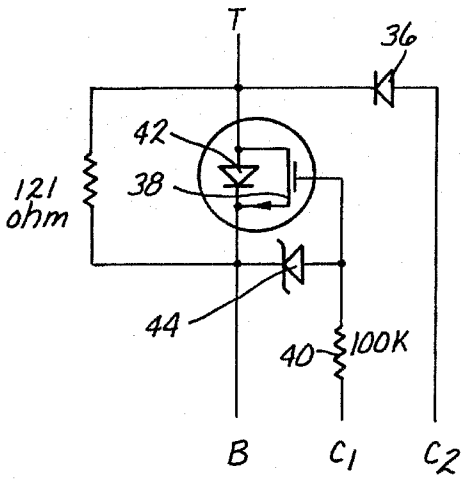
FIG. 3B is a circuit diagram of the preferred embodiment of the negative electronic module of the present invention.

Referring still to the bottom circuit of FIG. 2 and to FIG. 3B, a voltage limiting device, such as a Zener diode 44 is disposed between the gate of the electronic switch 38 and the cable 15.

The purpose of the voltage limiting device is to protect the gate from having a greater than permissible voltage difference between itself and the conductor. This is usually described in the specification of the electronic switch as the maximum permissible voltage between the gate and the source of the switch. In the herein described preferred embodiment this maximum voltage is approximately 20 V.

A second resistor 46 having resistance which is approximately of the same order of magnitude as the resistance of the blasting cap 30, but may also be several orders of magnitude greater, is disposed in series with the cable 15 and parallel with the electronic switch 38. As it will be explained below, the voltage limiting device (Zener diode 44) and the second resistor 46 are not necessary for accomplishing "select fire" detonation of charges, but are of useful practicality to protect the electronic switch (Zener diode) and for testing the gun assembly 14 for electrical continuity without detonating any charge.

Figure 3A:
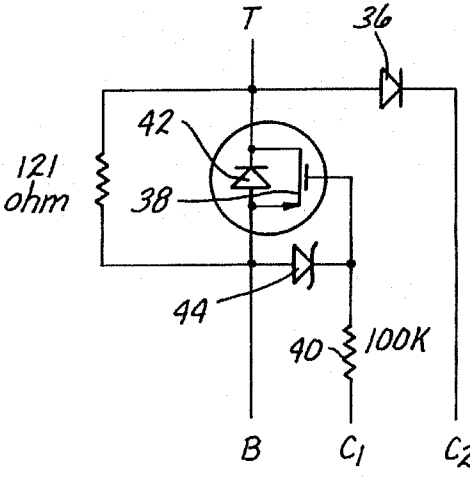
FIG. 3A is a circuit diagram of the preferred embodiment of the positive electronic module of the present invention.

The conductor cable below the circuit associated with the explosive charge on the bottom of the gun assembly is not connected to any further circuits, nor is it necessarily grounded. Nevertheless, as its is described later, it would not affect the operation of the device if the conductor cable 15 was grounded below the last circuit. It has been found in practice, that the electronic switch 38 and the second diode 42 may be available commercially as one component. In the presently preferred embodiment a MOSET transistor and a diode is used in combination, purchased as transistor IRF830 or an IRF9620, respectively, for the positively and negatively gated switches. For this reason the electronic switch 38 and the second diode 42 are shown in FIGS. 2 and 3B together, in an ellipsoid. In the preferred embodiment the first diode 36 bears the IN4007 designation. All of the electronic components shown in FIG. 3B and in the bottom circuit of FIG. 2, except for the blasting cap 30, are preferably incorporated within the electronic module 32, and a module such as the one having the circuit of FIG. 3B is termed a "negative module". FIG. 4A shows the outside appearance of the preferred embodiment of the negative module. A similar module, designed to detonate a charge on application of positive voltage is termed a "positive module" and is shown by FIG. 3A and FIG. 4B. Each of these modules has 4 lead wires, which are preferably color coded for ease of mounting in the gun assembly 14. The use of the color coded leads is explained further below.

Referring now to the circuit shown second from the bottom up in FIG. 2, and shown (in part) on FIG. 3A, the basic components of this circuit, to be incorporated into a "positive module" are the same as described above, with the following differences. The first terminal of the blasting cap 30 and the gate of electronic switch are both connected to the dart 26, which, however is not grounded until the charge below has been detonated. The first diode 36 is mounted in reverse polarity to the diode of the negative module, the electronic switch 38 closes when positive voltage is applied to the gate and the voltage limiting Zener diode 44 is mounted in reverse polarity to the one described for a negative module. The second diode 42 is, again, mounted with reverse polarity to the first diode 36 of the same circuit.

The circuit associated with the third explosive charge 23 from the bottom up, is again designed to detonate on application of negative voltage and has circuitry similar to the bottom circuit (negative module) with the difference that the blasting cap 30 and gate are electrically connected to the dart 26 which is not grounded. The fourth charge (from the bottom up) has positive circuitry, like the second charge. The number of explosive charges which may be incorporated in the gun assembly in a similar fashion is without limitation as far as the ability to cause their select fire detonation in accordance with the present invention, is concerned. The operation of the gun assembly in accordance with the invention is now described as follows.

As it was noted above, the explosive charge 23 on the bottom of the gun assembly is to be detonated first. Because in the example described here the bottom charge is designed to activate or set off on negative current, negative voltage (in the approximate range of 50 to 200 V) is applied on the surface by use of the switch 34. The path of the current, from the surface down to the bottom, is as follows. The logging cable 15 itself comprises a resistance in the range of approximately 50 to 200 Ω, and this resistance is indicated on FIG. 2 as resistor 48. The negative current passes through the resistor 48, and with virtually no resistance through the second diode 42 of the positive electronic module 32 associated with the upper most charge 23. The first diode 36 of this circuit does not permit negative current, and neither does the electronic switch 38 because its gate does not receive voltage. No current flows through the blasting cap 30 associated with the first charge 23 on the top and consequently it is not set off. In the negative electronic module 32 associated with the charge 23 second from the top, the second diode 42 does not permit negative current, but the first diode 36 does and therefore negative voltage is applied to the gate of the electronic switch 38. Consequently this switch is closed, and negative current passes through the second module with virtually no resistance. The corresponding blasting cap 30, however, does not have sufficient current to set it off. The third circuit or module 32 from the top down is again a positive module and the negative current passes through it the same way as through the first module.

The bottom circuit or module 32 is negative. When negative current reaches this module 32, it does not pass through the second diode 42, nor through the open electronic switch which is grounded, but it passes through the first diode and the blasting cap 30 which then draws enough current to be activated, as intended. Moreover, this happens whether or not the conductor of the logging cable 15 below the bottom module is grounded.

In the event, through error or oversight, positive voltage is applied at the surface when it is intended to detonate the bottom charge in the herein described before embodiment, then no detonation occurs for the following reason. None of the first three blasting caps are grounded, and therefore no current passes through them to set them off. Although positive voltage will reach the module 32 associated with the bottom charge, if the conductor 15 of the logging cable is grounded then current passes through the second diode 42 to the ground, and does not flow through the blasting cap 30. If the conductor 15 of the logging cable is not grounded, then positive current cannot pass through the last module, and, again, the blasting cap 30 is not set off.

Figure 5:
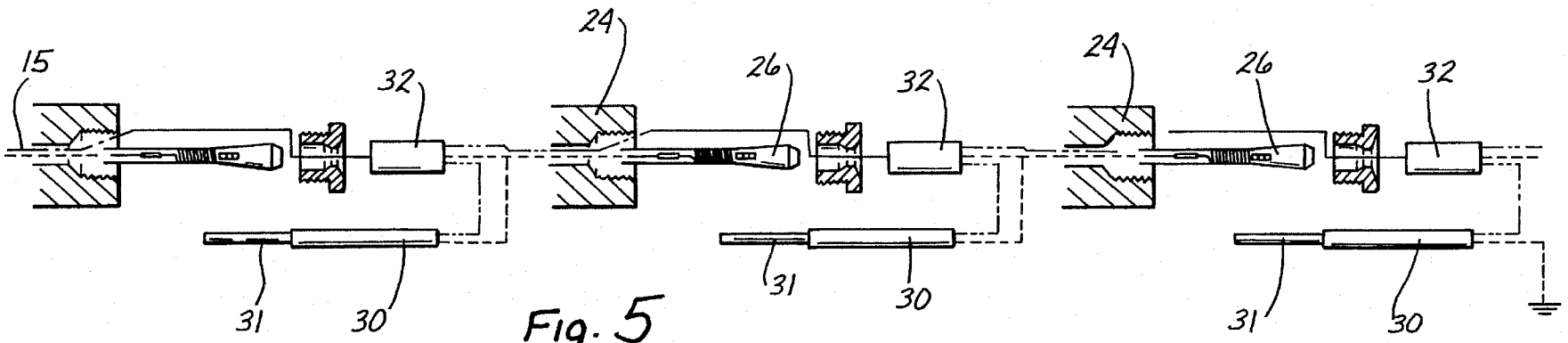
FIG. 5 is a schematic view of the components assembled in the gun assembly in accordance with the present invention.

After explosion of the first charge 23, the dart 26 associated with the charge above the bottom charge becomes grounded. The dashed lines in FIG. 2 and FIG. 5 represent conductors which become grounded only after explosion of the charge below. The charge second from the bottom is intended to be set off with positive current, regardless whether or not the conductor 15 of the logging cable below has been left grounded as a result of the earlier detonation. Positive current flows through the blasting cap 30 of this charge because the first diode 36 of the corresponding electronic module 32 allows current to flow through the blasting cap 30 to the ground. Inadvertent application of negative voltage on the surface would not set off this blasting cap 30, because the first diode 36 will prevent flow of current through the cap 30.

It should be readily understood by those skilled in the art from the foregoing description that a substantially unlimited number of shaped explosive charges can be assembled and detonated in a "select fire" manner in accordance with the present invention. When constructing a gun assembly in accordance with the present invention, the shaped charges 23, darts 26 and other hardware are assembled substantially as in the prior art. In contrast with the prior art, however, the electronic module 32 of the present invention is wired at one end thereof in series to the logging cable 15, and at the other end thereof with its respective lead wires to the two leads of the blasting cap 30, (or one wire to the dart 26) and logging cable 15. The first terminal of the blasting cap 30 on the bottom of the gun assembly is grounded. The blasting cap 30 on the bottom is arbitrarily assigned either a negative or positive module 30, and the remaining modules sequentially alternate in polarity. In the preferred embodiment of the electronic module 32 of the present invention the lead wires are color coded. FIG. 4A shows a negative module, and FIG. 4B shows a positive module. The yellow and blue lead wires in these embodiments are connected to the logging cable 15 in series, and the other two lead wires are connected to the two leads of the blasting cap (or one to the dart 26) respectively. FIG. 3B is the circuit diagram of a negative module and FIG. 3A is the circuit diagram of a positive module. In these figures the leads labeled T and B are connected to the logging cable 15, $C_1$ is connected to the first terminal, and $C_2$ is connected to the second terminal of the blasting cap 30. The first terminal of all blasting caps 30 other than the one on the bottom, is connected to the dart 26.

The Zener diodes 44 incorporated in the electronic module of the present invention are an optional feature and serve to protect the gates of the electronic switches 38 from voltage in excess of approximately 20 V. The gates of the electronic switches are designed not to close the switch unless sufficient voltage (usually in excess of 1 V) of the right polarity is applied. The second resistors 46 provide a path parallel with the respective diodes and electronic switches when the gun assembly 14 is tested for continuity with low voltage that is insufficient to close the electronic switches. Low voltage must be applied for testing, in order to avoid setting off any of the blasting caps.

What has been described above is a select fire gun assembly containing multiple explosive charges and resistive blasting caps which can be detonated in a select fire manner by sequentially applying direct current voltage of alternating polarity from the surface, and an electronic module that is incorporated in the gun assembly to render the select fire detonations possible. An important advantage of the abovedescribed gun assembly and electronic module of the invention is that it functions well with charges set off by resistive blasting caps.

Several modifications of the present invention may become readily apparent to those skilled in the art in light of the foregoing disclosure. For example, instead of diodes a functional equivalent can be used, that is a device which passes current in only one direction. Still further by way of example, it is noted that a transistor could be used for this purpose, and in such case the transistor would function as a diode. Therefore the terminology "diode" in this application should be interpreted meaning a diode, transistor or other devices used in the invention to function as a diode for passing current only in one direction. In light of the foregoing, the scope of the present invention should be interpreted solely from the following claims, as such claims are read in light of the disclosure.

What is claimed is:

1. A select fire gun assembly for jet perforating of underground well casings, having a plurality of explosive charges and capable of sequentially detonating each one of the charges by applying d. c. voltage of alternating polarity from the surface, the gun assembly comprising:

a closed tubular carrier having a plurality of internal compartments, the compartments being separated from one another by baffles, and each of said compartments containing an explosive charge to be detonated and a blasting cap attached to each explosive charge, the blasting cap capable of being activated by passage of current therethrough, and having a first and second electrical terminus, each of the baffles containing a dart mounted into the baffle without being in electrical contact therewith and capable of sealing the baffle and electrically grounding the dart only after the explosive charge in the compartment immediately below has detonated, the last blasting cap on the bottom of the gun assembly being electrically grounded at its first terminus, the remaining blasting caps being electrically connected at their respective first terminus to the dart of the respective baffle of the compartment wherein the blasting cap is located;

a d. c. voltage source on the surface;

a switch controlling said voltage source;

a logging cable that comprises a conductor connected to the switch whereby negative or positive voltage may be applied to the conductor at the option of an operator, and in operative connection with each blasting cap a first diode interposed between the second terminus of the blasting cap and the conductor, an electronic switch in series with the conductor, the electronic switch being responsive to the voltage on the first terminus of the blasting cap, and a second diode in series with the conductor and parallel with the electronic switch, the first and second diodes being disposed with opposite polarity, and the electronic switch capable of passing current through when the voltage applied to the conductor is passed through the first diode and there is voltage at the first terminus of the blasting cap, said first and second diodes and electronic switch being arranged with alternating polarity for the blasting caps, whereby sequentially applying d. c. voltage of alternating polarity to the logging cable activates the blasting caps and detonates the explosive charges in sequential order starting with the explosive charge on the bottom of the gun assembly.

2. The select fire gun assembly of claim 1 wherein the blasting cap has a resistance of at least approximately 50 Ω and requires at least approximately 25 V for being activated.

3. The select fire gun assembly of claim 2 further comprising a first resistor having a resistance of orders of magnitude greater than the resistance of the blasting cap, said first resistor being interposed in series between the gate of each electronic switch and the first terminus of the blasting cap.

4. The select fire gun assembly of claim 3 further comprising a second resistor connected to the conductor parallel with the electronic switch, the second resistor having an electric resistance which is at least approximately the order of magnitude as the resistance of the blasting cap.

5. The select fire gun assembly of claim 4 further comprising a voltage limiting device interconnected between the gate of the electronic switch and the source of the switch.

6. The select fire gun assembly of claim 2 wherein the first and second diodes and electronic switch for each blasting cap are mounted in a single housing, said housing having four lead wires which extend from said housing and two of which are electrically connected in series to the conductor of the logging cable and the other two being connected respectively to the first and second terminus of the blasting cap.

7. The select fire gun assembly of claim 6 wherein the second diode and electronic switch are comprised in an IRF830 or in an IRF9620 switching device.

8. The select fire gun assembly of claim 5 wherein the first and second diodes, electronic switch, first and second resistors and voltage limiting device for each blasting cap are mounted in a single housing, said housing having four lead wires which extend from said housing and two of which are electrically connected in series to the conductor of the logging cable and the other two being connected respectively to the first and second terminus of the blasting cap.

9. The select fire gun assembly of claim 8 wherein the second diode and electronic switch are comprised in an IRF830 or in an IRF9620 switching device.

10. The select fire gun assembly of claim 9 wherein the voltage limiting device is a Zener diode.

11. A plurality of electronic modules for use in a select fire gun assembly for jet perforating of underground well casings, the gun assembly having a plurality of explosive charges to be detonated sequentially by applying d. c. voltage of alternating polarity from the surface, the gun assembly further having a closed tubular carrier including a plurality of internal compartments, the compartments being separated from one another by baffles, and each of said compartments containing an explosive charge to be detonated, and a blasting cap attached to each explosive charge, the blasting cap capable of being activated by passage of current therethrough, and having a first and second electrical terminus, each of the baffles containing a dart mounted into the baffle without being in electrical contact therewith and capable of sealing the baffle and electrically grounding the dart only after the explosive charge in the compartment immediately below has detonated, the last blasting cap on the bottom of the gun assembly being electrically grounded at its first terminus, the remaining blasting caps being electrically connected at their respective first terminus to the dart of the respective baffle of the compartment wherein the blasting cap is located; a d. c. voltage source on the surface; a switch controlling said voltage source; a logging cable that comprises a conductor connected to the switch whereby negative or positive voltage may be applied to the conductor at the option of an operator, each electronic module comprising:

a first diode to be electrically connected between the second terminus of the blasting cap and the conductor;

an electronic switch to be connected in series with the conductor, the electronic switch being responsive to the voltage on the first terminus of the blasting cap, and a second diode parallel with the electronic switch and to be connected in series with the conductor, the first and second diodes being disposed with opposite polarity, and the electronic switch capable of passing current through when the voltage applied to the conductor is passed through the first diode and there is voltage at the first terminus of the blasting cap, said first and second diodes and electronic switch being arranged with alternating polarity for the blasting caps, whereby sequentially applying d. c. voltage of alternating polarity to the logging cable activates the blasting caps and detonates the explosive charges in sequential order starting with the explosive charge on the bottom of the gun assembly.

12. The electronic modules of claim 11 where each module further comprises a first resistor having a resistance of orders of magnitude greater than the resistance of the blasting cap, said first resistor to be connected in series between the gate of each electronic switch and the first terminus of the blasting cap.

13. The electronic modules of claim 12 where each module further comprises a second resistor to be connected to the conductor parallel with the electronic switch, the second resistor having an electric resistance which is at least approximately the order of magnitude of the resistance of the blasting cap.

14. The electronic modules of claim 13 where each module further comprises a voltage limiting device interconnected between the gate of the electronic switch and the source of the switch.

15. The electronic modules of claim 14 where each module is mounted in a single housing, said housing having four lead wires which extend from said housing, two of the lead wires are to be electrically connected in series to the conductor of the logging cable and the other two to be connected respectively to the first and second terminus of the blasting cap.

16. The electronic modules of claim 15 where the second diode and electronic switch of each module are comprised in an IRF830 or in an IRF9620 switching device.

17. A plurality of electronic modules for use in a select fire gun assembly for jet perforating of underground well casings, the gun assembly having a plurality of explosive charges each of which is to be detonated by activating a resistive blasting cap attached to each charge, without detonating the remaining charges, by sequentially applying d. c. voltage of alternating polarity from the surface to a conductor cable of the gun assembly, at least one negative electronic module which comprises:

a housing;

a first and a second lead wire extending from the housing to be connected in series with the conductor of the gun assembly, an electronic switch having a drain, a source and a gate, the drain and source being connected in series between the first and second lead wires;

a first diode connected to the drain of the electronic switch, a third lead wire which extends from the housing being connected to the first diode and is to be electrically connected to a terminus of a first blasting cap;

a first resistor electrically connected in series between the gate and a fourth lead wire which extends from the housing and is to be connected to the other terminus of the first blasting cap;

a second diode connected in series between the first and second leads and parallel with the electronic switch, the electronic switch and the first diode being such that only negative voltage passes through the first diode and closes the electronic switch, the second diode being of opposite polarity to the first diode and therefore passes only positive voltage through the electronic module, and at least one positive electronic module which comprises:

a housing;

a first and a second lead wire extending from the housing to be connected in series with the conductor of the gun assembly, an electronic switch having a drain, a source and a gate, the drain and source being connected in series between the first and second lead wires;

a first diode connected to the drain of the electronic switch, a third lead wire which extends from the housing being connected to the first diode to be electrically connected to a terminus of a second blasting cap;

a first resistor electrically connected in series between the gate and a fourth lead wire which extends from the housing and is to be connected to the other terminus of the second blasting cap;

a second diode connected in series between the first and second leads and parallel with the electronic switch, the electronic switch and the first diode being of such polarity that only positive voltage passes through the first diode and closes the electronic switch, the second diode being of opposite polarity to the first diode and therefore passes only negative voltage through the electronic module.

18. The electronic modules of claim 17 wherein the first resistor has several orders of magnitude greater resistance than the resistive blasting cap used in the gun assembly.

19. The electronic modules of claim 17 wherein each module further comprises a second resistor electrically connected between the first and second lead wires parallel with the electronic switch and the second diode, and a voltage limiting device connected between the source and gate of the electronic switch.

20. The electronic modules of claim 17 wherein the second diode and the electronic switch of the positive module is comprised in an IRF830 switching device and wherein the second diode and the electronic switch of the negative module is comprised in an IRF9620 switching device.

* * * * *